US009030483B2

(12) United States Patent
Kim et al.

(10) Patent No.: US 9,030,483 B2
(45) Date of Patent: May 12, 2015

(54) IMAGE DISPLAY DEVICE DISPLAYING MULTI-PRIMARY COLOR AND METHOD OF DRIVING THE SAME

(75) Inventors: Young-Hoon Kim, Goyang-si (KR); Han-Sang Lee, Seoul (KR)

(73) Assignee: LG Display Co., Ltd., Seoul (KR)

( * ) Notice: Subject to any disclaimer, the term of this patent is extended or adjusted under 35 U.S.C. 154(b) by 124 days.

(21) Appl. No.: 13/303,993

(22) Filed: Nov. 23, 2011

(65) Prior Publication Data

US 2012/0133670 A1 May 31, 2012

(30) Foreign Application Priority Data

Nov. 26, 2010 (KR) ..... 10-2010-0118747
Aug. 10, 2011 (KR) ..... 10-2011-0079431

(51) Int. Cl.
*G09G 5/02* (2006.01)

(52) U.S. Cl.
CPC ..... *G09G 5/02* (2013.01); *G09G 2320/0242* (2013.01); *G09G 2340/06* (2013.01); *G09G 2360/16* (2013.01); *G09G 2300/0452* (2013.01)

(58) Field of Classification Search
CPC ..... G06T 5/007
USPC ..... 345/593, 690
See application file for complete search history.

(56) References Cited

U.S. PATENT DOCUMENTS 5,233,413 A * 8/1993 Fuchsberger ..... 358/518
6,453,067 B1 * 9/2002 Morgan et al. ..... 382/162
2005/0280718 A1 * 12/2005 Une ..... 348/223.1
2008/0112489 A1 * 5/2008 Malladi et al. ..... 375/240.22
2008/0204480 A1 8/2008 Van Mourik et al.
2009/0278867 A1 * 11/2009 Brown Elliott et al. ..... 345/690
2010/0103187 A1 * 4/2010 Linssen

FOREIGN PATENT DOCUMENTS

TW 200623001 A 7/2006
TW 201017640 A 5/2010

OTHER PUBLICATIONS

Office Action issued in corresponding Chinese Patent Application No. 201110380767.8, mailed Nov. 18, 2013, 13 pages.
Office Action issued in corresponding Taiwan Patent Application No. 100140344, mailed Dec. 19, 2013, 19 pages.

* cited by examiner

*Primary Examiner* — Mark Zimmerman
*Assistant Examiner* — Vu Nguyen
(74) *Attorney, Agent, or Firm* — Brinks Gilson & Lione

(57) ABSTRACT

An image display device includes: a display panel including a plurality of pixels and displaying an image; a color converting portion generating a converted image signal regarding red, green and blue colors and an auxiliary primary color from an original image signal regarding red, green and blue colors using one of a plurality of gains corresponding to the plurality of pixels, respectively; and a data signal generating portion generating a data signal from the converted image signal and supplying the data signal to the display panel.

22 Claims, 8 Drawing Sheets

IMAGE DISPLAY DEVICE DISPLAYING MULTI-PRIMARY COLOR AND METHOD OF DRIVING THE SAME

This application claims the benefit of Korean Patent Applications No. 10-2010-0118747, filed on Nov. 26, 2010 and No. 10-2011-0079431, filed on Aug. 10, 2011, the entire contents of which is incorporated herein by reference for all purposes as if fully set forth herein.

BACKGROUND

1. Field of the Invention

The present disclosure relates to an image display device, and more particularly, to an image display device displaying a multi-primary color and a method of driving the image display device.

2. Discussion of the Related Art

As information age progresses, demand for display device that displays images has increased. Recently, various flat panel displays (FPDs) such as a liquid crystal display (LCD), a plasma display panel (PDP) and an organic light emitting diode (OLED) have been utilized. In general, the flat panel display (FPD) includes a display panel displaying images and a driving portion generating a data signal for displaying the images.

FIG. 1 is an image display device according to the related art. In FIG. 1, an image display device 10 includes a display panel 20 that displays an image using a plurality of pixels P and a driving portion 30 that generates a data signal for displaying the image from an image signal R, G, B and supplies the data signal to the display panel 20. The display panel 20 includes the plurality of pixels P each having red, green and blue sub-pixels Pr, Pg and Pb. The display panel 20 displays the image of a frame by applying the different data signals to the plurality of pixels P.

The driving portion 30 includes a data signal generating portion 60. The driving portion 30 receives the image signal R, G, B and a plurality of control signals from an external system portion 70 such as a graphic card or a television system. In addition, the driving portion 30 generates the data signal and supplies the data signal to the display panel 20. For example, the data signal generating portion 60 may generate the data signal of an analog type using the data signal of a digital type and the plurality of control signals supplied from the system portion 70. Further, the data signal generating portion 60 may include a timing controlling portion and a data driving integrated circuit.

Since the image display device 20 according to the related art displays the image using the red, green and blue sub-pixels Pr, Pg and Pb, there is a limit in displaying various colors in a state of nature. The white color displayed by a combination of three primary colors of light such as red, green and blue has a relatively low brightness. In addition, as an image by the combination of three primary colors of light such as red, green and blue has a higher brightness, a cognitive component of the image is degraded. Accordingly, additional primary colors are required to display various colors as a state of nature.

BRIEF SUMMARY

An image display device includes: a display panel including a plurality of pixels and displaying an image; a color converting portion generating a converted image signal regarding red, green and blue colors and an auxiliary primary color from an original image signal regarding red, green and blue colors using one of a plurality of gains corresponding to the plurality of pixels, respectively; and a data signal generating portion generating a data signal from the converted image signal and supplying the data signal to the display panel.

In another aspect, a method of driving an image display device includes: generating a converted image signal regarding red, green and blue colors and an auxiliary primary color from an original image signal regarding red, green and blue colors using one of a plurality of gains in a color converting portion; generating a data signal from the converted image signal in a data signal generating portion; and displaying an image using the data signal in a display panel including a plurality of pixels.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE DRAWINGS AND THE PRESENTLY PREFERRED EMBODIMENTS

Reference will now be made in detail to embodiments of the present invention, examples of which are illustrated in the accompanying drawings. Wherever possible, similar reference numbers will be used to refer to the same or similar parts.

Figure 1:
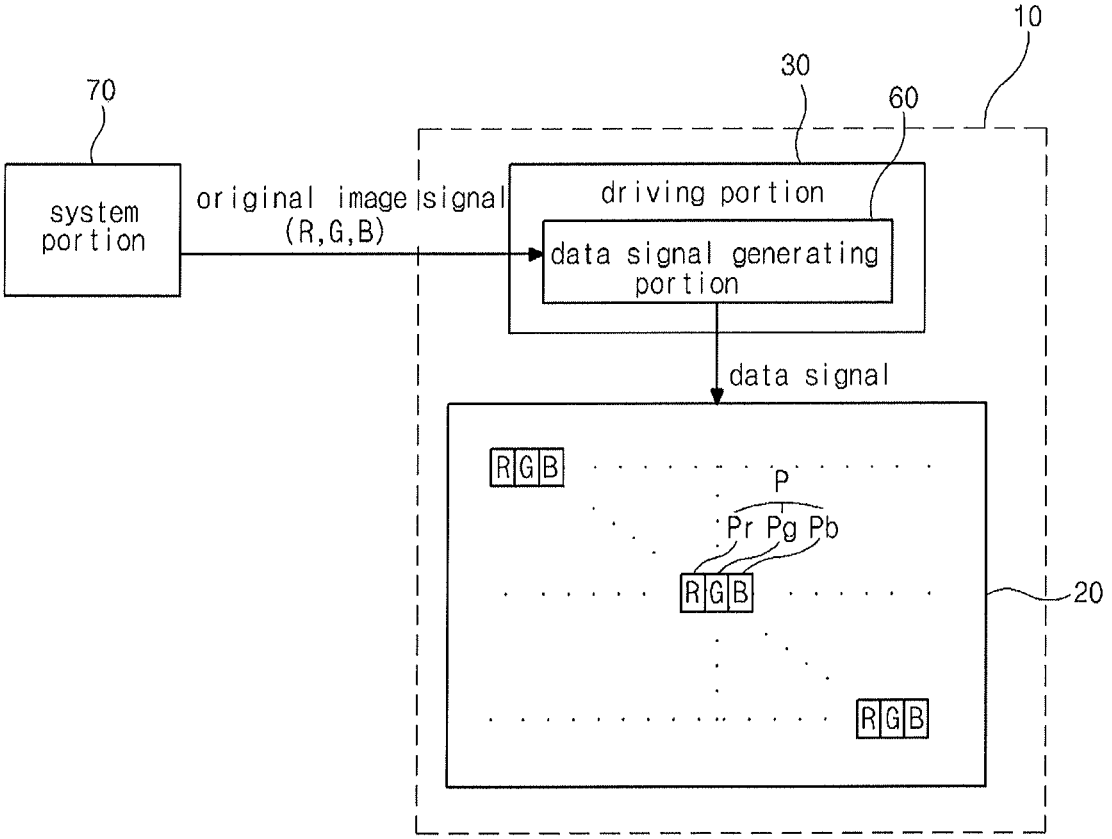
(related art) FIG. 1
FIG. 1 is an image display device according to the related art.
Figure 2:
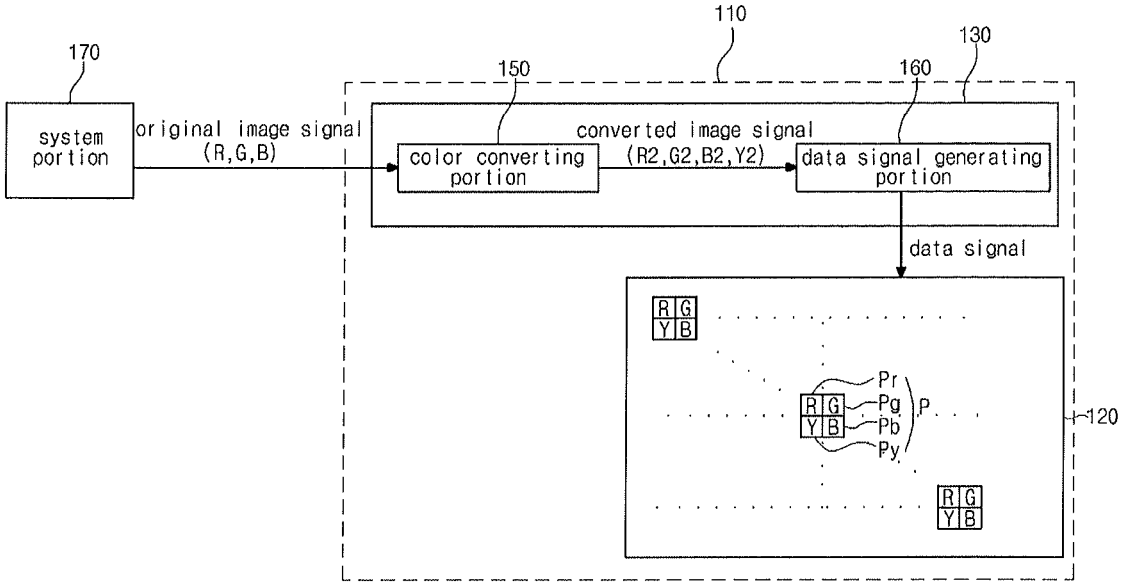
FIG. 2 is a view showing an image display device according to a first embodiment of the present invention.

FIG. 2 is a view showing an image display device according to a first embodiment of the present invention.

In FIG. 2, an image display device 110 according to a first embodiment of the present invention includes a display panel 120 that displays an image using a plurality of pixels P and a driving portion 130 that generates a data signal from an original image signal R, G, B and supplies the data signal to the display panel 120. The display panel 120 that uses a yellow color as an auxiliary primary color includes the plurality of pixels P each having red, green, blue and yellow sub-pixels Pr, Pg, Pb and Py. The display panel 120 displays the image of a frame by applying the data signals to the plurality of pixels P.

The driving portion 130 includes a color converting portion 150 and a data signal generating portion 160. The driving portion 130 receives the original image signal R, G, B and a plurality of control signals from an external system portion 170 such as a graphic card or a television system. In addition, the driving portion 130 generates the data signal using the original image signal R, G, B and the plurality of control signals and supplies the data signal to the display panel 120.

For example, the system portion 170 may supply the original image signal R, G, B of a digital type regarding red, green and blue colors and the plurality of control signals including a data enable signal (DE), a vertical synchronization signal (VSY), a horizontal synchronization signal (HSY) and a clock signal (CLK) to the driving portion 130. The color converting portion 150 may generate a converted image signal R2, G2, B2, Y2 of a digital type regarding red, green, blue and yellow colors from the original image signal R, G, B of a digital type regarding red, green and blue colors and may supply the converted image signal R2, G2, B2, Y2 to the data signal generating portion 160. In addition, the data signal generating portion 160 may generate the data signal of an analog type regarding red, green, blue and yellow colors using the converted image signal R2, G2, B2, Y2 of a digital type and the plurality of control signals and may supply the data signal to the display panel 120.

The data signal of an analog type regarding red, green, blue and yellow colors are applied to red, green, blue and yellow sub-pixels Pr, Pg, Pb and Py, respectively, of the display panel 120. As a result, the corresponding pixel P may display a colored image close to a state of nature.

Operation of the driving portion 130 will be illustrated referring to drawings hereinafter.

Figure 3:
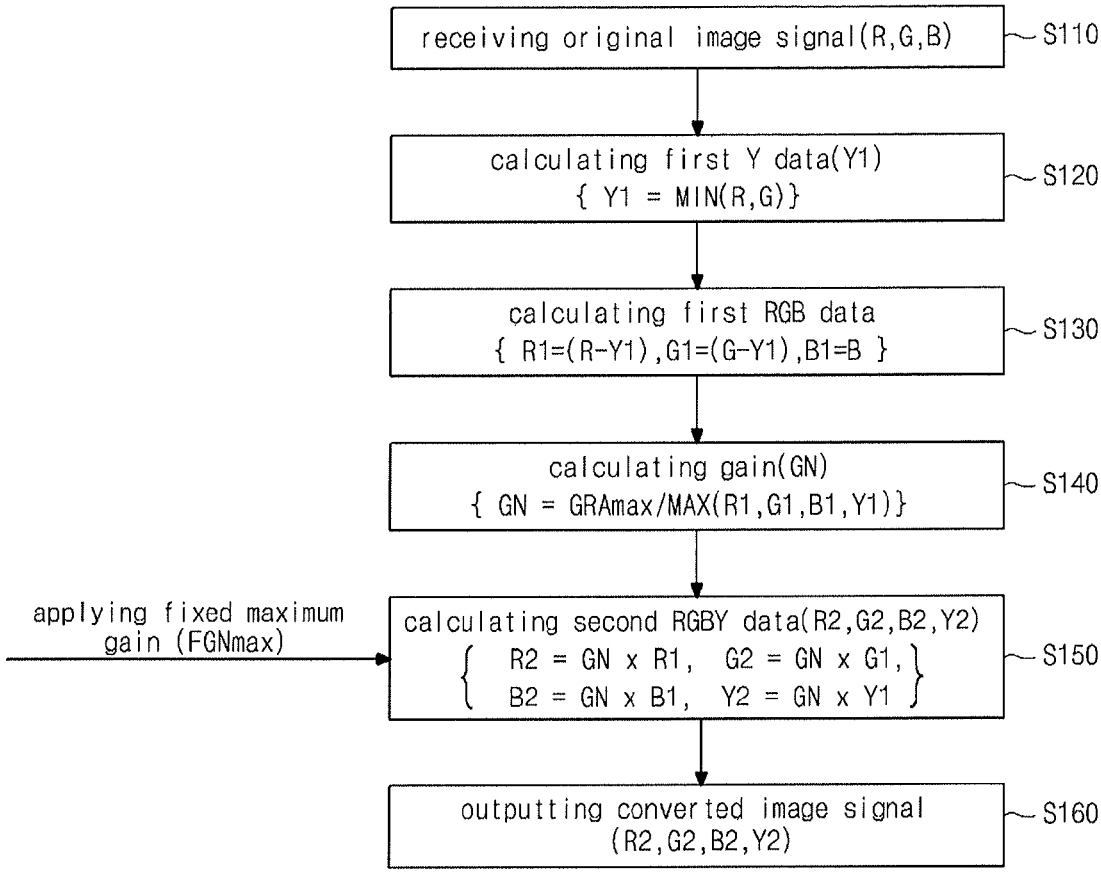
FIG. 3 is a flow chart showing a method of driving a driving portion of an image display device according to a first embodiment of the present invention.
Figure 4:
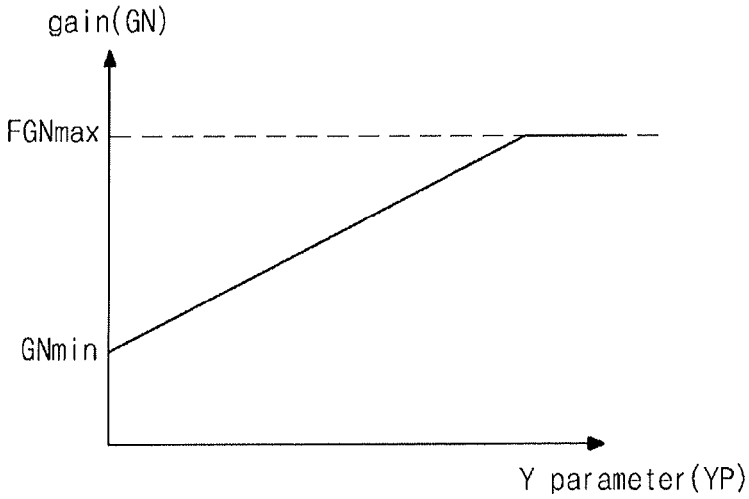
FIG. 4 is a graph showing a gain with respect to a Y parameter used for a method of driving a driving portion of an image display device according to a first embodiment of the present invention.

FIG. 3 is a flow chart showing a method of driving a driving portion of an image display device according to a first embodiment of the present invention, and FIG. 4 is a graph showing a gain with respect to a Y parameter (as an example of the auxiliary primary color parameter) used for a method of driving a driving portion of an image display device according to a first embodiment of the present invention.

In FIG. 3, the color converting portion 150 (of FIG. 2) of the driving portion 130 (of FIG. 2) receives the original image signal R, G, B regarding red, green and blue colors from the system portion 170 (of FIG. 2) (S110) and calculates a first Y data Y1 from the original image signal R, G, B (S120). Here, the first Y data Y1 is calculated by using red and green components R, G of the original image signal R, G, B. For example, a minimum value MIN(R, G) of the red and green components R, G may be determined as the first Y data Y1. (Y1=MIN(R, G))

In addition, the color converting portion 150 calculates a first RGB data R1, G1, B1 by using the original image signal R, G, B and the first Y data Y1 (S130). For example, differences obtained by subtracting the first Y data Y1 from the red and green components R and G may be determined as first R and G data R1 and G1, respectively, and a blue component B of the original image signal R, G, B may be determined as a first B data B1. (R1=R−Y1, G1=G−Y1, B1=B) Here, the first Y data Y1 obtained in the step S120 and the first RGB data R1, G1, B1 obtained in the step S130 may be defined as a first RGBY data R1, G1, B1, Y1.

Further, the color converting portion 150 calculates a gain GN by using the first RGBY data R1, G1, B1, Y1 (S140). For example, a quotient obtained by dividing a maximum value GRAmax of gray levels GRA of the display panel 120 by a maximum value MAX(R1, G1, B1, Y1) of the first RGBY data R1, G1, B1, Y1 may be determined as the gain GN. (GN=GRAmax/MAX(R1, G1, B1, Y1))

Moreover, the color converting portion 150 calculates a second RGBY data R2, G2, B2, Y2 by using the first RGBY data R1, G1, B1, Y1 and the gain GN with a fixed maximum gain FGNmax applied as an upper limit of the gain GN (S150). For example, a product obtained by multiplying the first RGBY data R1, G1, B1, Y1 and the gain GN may be determined as the second RGBY data R2, G2, B2, Y2. (R2=GN*R1, G2=GN*G1, B2=GN*B1, Y2=GN*Y1)

In addition, the color converting portion 150 outputs the second RGBY data R2, G2, B2, Y2 as a converted image signal R2, G2, B2, Y2 to the data signal generating portion 160 (S160). The data signal generating portion 160 converts the converted image signal R2, G2, B2, Y2 from a digital type to an analog type and supplies the converted image signal R2, G2, B2, Y2 of an analog type as the data signal to the display panel 120.

The procedure for calculating the second RGBY data R2, G2, B2, Y2 will be illustrated referring to an exemplary original image signal corresponding to a single pixel P.

For example, when the original image signal R, G, B corresponding to a single pixel P of the display panel 120 displaying 256 gray levels is (150, 200, 160) and the fixed maximum gain FGNmax is 2, the first Y data may be determined as 150. (Y1=MIN(150, 200)=150) In addition, the first RG data R1, G1 may be determined as 0 and 50, respectively, and the first B data B1 may be determined as 160. (R1=(150−150)=0, G1=(200−150)=50, B1=160) Since the maximum value GRAmax of 256 gray levels is 255 and a maximum value of the first RGBY data R1, G1, B1, Y1 is 160, the gain GN may be determined as 1.59. (MAX(0, 50, 160, 150)=160, GN=255/160=1.59) Since the obtained gain GN is smaller than the fixed maximum gain FGNmax, the second RGBY data R2, G2, B2, Y2 may be determined as 0, 79.5, 254.4, 238.5, respectively. (R2=1.59*0=0, G2=1.59*50=79.5, B2=1.59*160=254.4, Y2=1.59*150=238.5)

Here, the procedure for calculating the second RGBY data R2, G2, B2, Y2 in the steps S120 to S150 may be performed for a plurality of original image signals R, G, B corresponding to the plurality of pixels P of the display panel 120. Since the plurality of original image signals R, G, B corresponding to the plurality of pixels P have different values from each other, the obtained gains GN corresponding to the plurality of pixels P, may have different values from each other. As a result, the color converting portion 150 generates the plurality of converted image signals R2, G2, B2, Y2 from the plurality of original image signals R, G, B using the plurality of gains GN corresponding to the plurality of pixels P, respectively.

When the first RGBY data R1, G1, B1, Y1 is used as the converted image signal R2, G2, B2, Y2, brightness of the image is reduced because the first RG data R1, G1 is obtained by subtracting the first Y data Y1 from the red and green components R, G of the original image signal R, G, B. Accordingly, the converted image signal R2, G2, B2, Y2 is obtained by multiplying the gain GN and the first RGBY data R1, G1, B1, Y1. That is, since the first RGBY data R1, G1, B1, Y1 is obtained by subtracting the first Y data Y1 twice from and adding the first Y data Y1 once to the original image signal R, G, B, brightness of the first RGBY data R1, G1, B1, Y1 is smaller than brightness of the original image signal R, G, B. For the purpose of compensating reduction in brightness, the second RGBY data R2, G2, B2, Y2 obtained by multiplying the gain GN to the first RGBY data R1, G1, B1, Y1 is outputted as the converted image signal R2, G2, B2, Y2.

Here, when the gain GN corresponding to each pixel P is much higher, brightness may be excessively compensated. Accordingly, the second RGBY data R2, G2, B2, Y2 may be calculated using the fixed maximum gain FGNmax as an upper limit of the gain GN. When the gain GN obtained in the step S140 is not smaller than the fixed maximum gain FGNmax, the second RGBY data R2, G2, B2, Y2 may be calculated by multiplying the fixed maximum gain FGNmax instead of the obtained gain GN to the first RGBY data R1, G1, B1, Y1. For example, the fixed maximum gain FGNmax may be determined as 2.

As a result, the gain GN used for calculating the converted image signal R2, G2, B2, Y2 in the driving portion 130 of the image display device 110 according to the first embodiment of the present invention has various values equal to or smaller than the fixed maximum gain FGNmax according to the original image signal R, G, B.

As shown in FIG. 4, the gain GN varies according to a Y parameter YP of the original image signal R, G, B using the fixed maximum gain FGNmax as an upper limit. The Y parameter YP is defined from the red and green components R, G of the original image signal R, G, B which are two components of the original image signal R, G, B forming the yellow color. For example, the Y parameter YP may be defined as a quotient obtained by dividing the minimum value MIN(R, G) of the red and green components R, G by the maximum value MAX(R, G) of the red and green components R, G. (YP=MIN(R, G)/MAX(R, G))

Accordingly, in the image display device 110 according to the first embodiment of the present invention, since the converted image signal R2, G2, B2, Y2 is generated from the original image signal R, G, B using the gain GN having various values corresponding to the plurality of pixels P, brightness of the image is improved and the colors close to a state of nature are displayed.

In the image display device 110 according to the first embodiment of the present invention, since the plurality of gains GN are applied to the original image signal R, G, B corresponding to the plurality of pixels P using the fixed maximum gain FGNmax as a common upper limit, a gray level of a specific converted image signal R2, G2, B2, Y2 may be saturated and display quality of the image display device may be reduced.

In another embodiment, reduction in display quality may be prevented by using a variable maximum gain having different values according to a kind of image.

Figure 5:
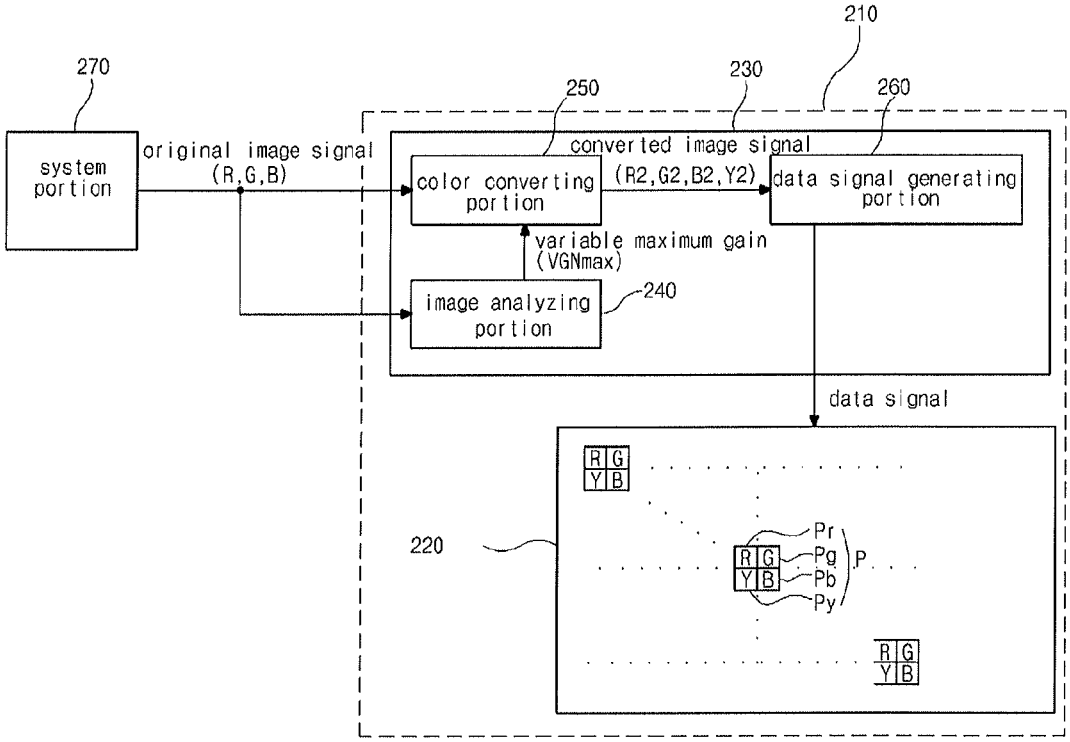
FIG. 5 is a view showing an image display device according to a second embodiment of the present invention.

FIG. 5 is a view showing an image display device according to a second embodiment of the present invention.

In FIG. 5, an image display device 210 according to a second embodiment of the present invention includes a display panel 220 that displays an image using a plurality of pixels P and a driving portion 230 that generates a data signal from an original image signal R, G, B and supplies the data signal to the display panel 220. The display panel 220 that uses a yellow color as an auxiliary color includes the plurality of pixels P each having red, green, blue and yellow sub-pixels Pr, Pg, Pb and Py. The display panel 220 displays the image of a frame by applying the different data signals to the plurality of pixels P.

The driving portion 230 includes an image analyzing portion 240, a color converting portion 250 and a data signal generating portion 260. The driving portion 230 receives the original image signal R, G, B and a plurality of control signals from an external system portion 270 such as a graphic card or a television system. In addition, the driving portion 230 generates the data signal using the original image signal R, G, B and the plurality of control signals and supplies the data signal to the display panel 220.

For example, the system portion 270 may supply the original image signal R, G, B of a digital type regarding red, green and blue colors and the plurality of control signals including a data enable signal (DE), a vertical synchronization signal (VSY), a horizontal synchronization signal (HSY) and a clock signal (CLK) to the driving portion 230. The image analyzing portion 240 may generate a variable maximum gain VGNmax corresponding to the original image signal R, G, B by analyzing the original image signal R, G, B of a digital type regarding red, green and blue colors and may supply the variable maximum gain VGNmax to the color converting portion 250. As an example, the image analyzing portion 240 may generate, for each pixel, a variable maximum gain VGNmax corresponding to the original image signal R, G, B as the upper limit of the gain for the pixel, by analyzing the original image signal R, G, B of a digital type regarding red, green and blue colors and may supply the variable maximum gain VGNmax to the color converting portion 250.

The color converting portion 250 may generate a converted image signal R2, G2, B2, Y2 of a digital type regarding red, green, blue and yellow colors from the original image signal R, G, B of a digital type regarding red, green and blue colors by using the variable maximum gain VGNmax and may supply the converted image signal R2, G2, B2, Y2 to the data signal generating portion 260. In addition, the data signal generating portion 260 may generate the data signal of an analog type regarding red, green, blue and yellow colors using the converted image signal R2, G2, B2, Y2 of a digital type and the plurality of control signals and may supply the data signal to the display panel 220.

The data signal of an analog type regarding red, green, blue and yellow colors are applied to red, green, blue and yellow sub-pixels Pr, Pg, Pb and Py, respectively, of the display panel 220. As a result, the corresponding pixel P may display a colored image close to a state of nature.

The image analyzing portion 240 that generates the variable maximum gain VGNmax by analyzing the original image signal will be illustrated referring to a drawing hereinafter.

Figure 6:
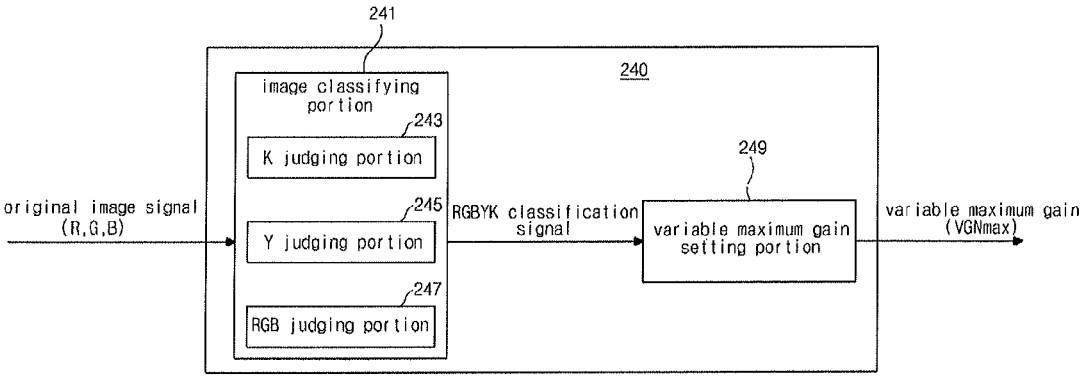
FIG. 6 is a view showing an image analyzing portion of an image display device according to a second embodiment of the present invention.

FIG. 6 is a view showing an image analyzing portion of an image display device according to a second embodiment of the present invention.

In FIG. 6, the image analyzing portion 240 includes an image classifying portion 241 and a variable maximum gain setting portion 249. The image classifying portion 241 classifies the original image signal R, G, B into a plurality of groups by analysis and generates an RGBYK classification signal including information of the group where the original image signal R, G, B belongs. The variable maximum gain setting portion 249 generates the variable maximum gain VGNmax according to the RGBYK classification signal. The variable maximum gain VGNmax corresponds to the group where the original image signal R, G, B belongs.

For example, when the plurality of groups include R, G, B, Y and K groups where red, green, blue, yellow and black colors are dominant, respectively, the image classifying portion 241 may includes a K judging portion 243, a Y judging portion 245 and an RGB judging portion 247. The K judging portion 243 may judge whether the original image signal R, G, B belongs to the K group where black color is dominant and the Y judging portion 245 may judge the original image signal R, G, B belongs to the Y group where yellow color is dominant. In addition, the RGB judging portion 247 may judge which one of the R, G and B groups where red, green and blue colors are dominant, respectively, the original image signal R, G, B belongs to.

For the purpose of clarifying discrimination among red, green and blue colors, the RGB judging portion 247 may include an RGB to HSV converting portion (not shown) that converts the original image signal R, G, B regarding red, green and blue colors into an image signal H, S, V regarding hue, saturation and value, and may judge which one of the R, G and B groups the original image signal R, G, B belongs to by analyzing the hue component of the image signal H, S, V.

The variable maximum gain setting portion 249 generates the variable maximum gain VGNmax according to the RGBYK classification signal from the image classifying portion 241. The variable maximum gain setting portion 249 may store information regarding a plurality of variable maximum gain VGNmax corresponding to the plurality of groups according to classification of the image Classifying portion 241 as a form of a look-up table (LUT). For example, when the image classifying portion 241 classifies an image of a frame into R, G, B, Y and K groups, the variable maximum gain setting portion 249 may store first to fifth variable maximum gain VGNmax corresponding to the R, G, B, Y and K groups, respectively.

Operation of the driving portion 230 will be illustrated referring to drawings hereinafter.

Figure 7:
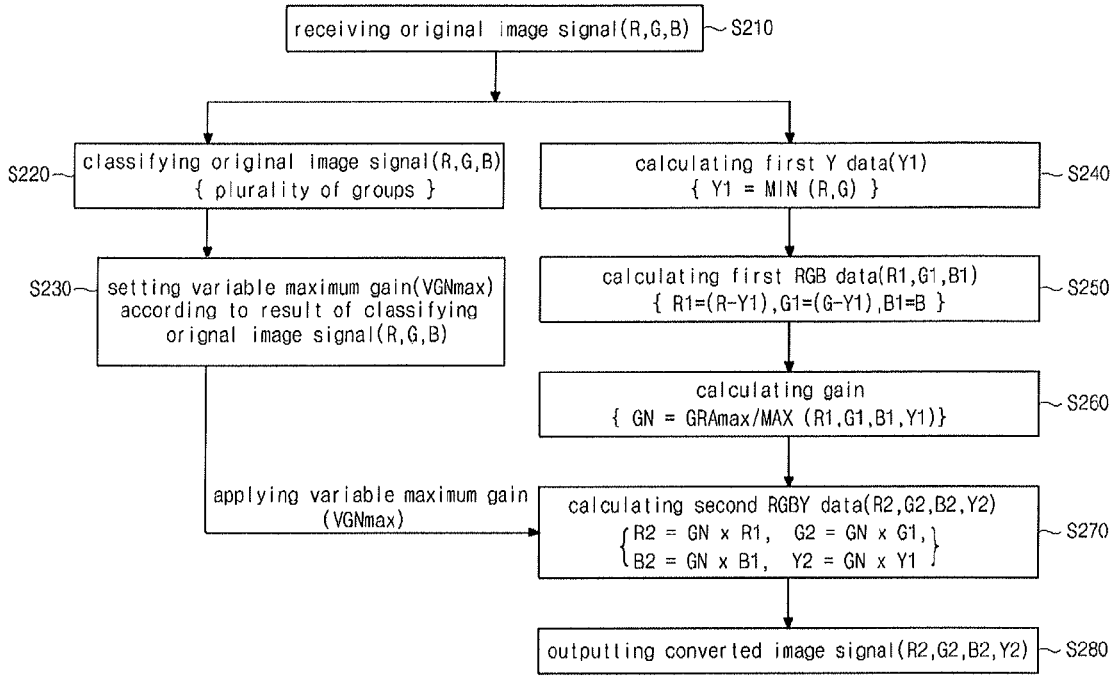
FIG. 7 is a flow chart showing a method of driving a driving portion of an image display device according to a second embodiment of the present invention.
Figure 8:
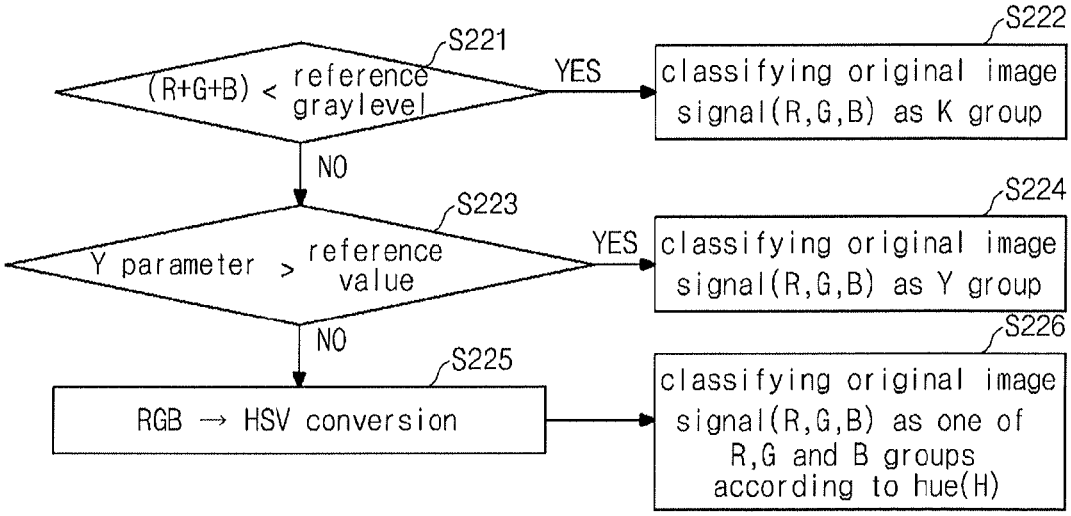
FIG. 8 is a flow chart showing a method of classifying an image in an image analyzing portion of a driving portion of an image display device according to a second embodiment of the present invention.

FIG. 7 is a flow chart showing a method of driving a driving portion of an image display device according to a second embodiment of the present invention, and FIG. 8 is a flow chart showing a method of classifying an image in an image analyzing portion of a driving portion of an image display device according to a second embodiment of the present invention.

In FIG. 7, when the driving portion 230 (of FIG. 5) receives the original image signal R, G, B regarding red, green and blue colors from the system portion 270 (of FIG. 5) (S210), the image analyzing portion 240 (of FIG. 5) analyzes the original image signal R, G, B and classifies the original image signal R, G, B into the plurality of groups (S220).

An image classification reference and an image classification method may be variously selected in the image analyzing portion 240. For example, as shown in FIG. 8 where the original image signal R, G, B is classified into the R, G, B, Y and K groups, the image classifying portion 241 (of FIG. 6) of the image analyzing portion 240 may compare a sum (R+G+B) of red, green and blue components R, G and B of the original image signal R, G, B with a reference gray level (S221) and may classify the original image signal R, G, B as the K group where the black color is dominant when the sum (R+G+B) of the red, green and blue components R, G and B is smaller than the reference gray level.

Here, the reference gray level may be determined through various methods. For example, the original image signal R, G, B having a gray level lower than the $20^{th}$ gray level may be judged to have such a low brightness that a user can not discriminate therebetween. As a result, the $20^{th}$ gray level may be determined as the reference gray level and the original image signal R, G, B having a gray level lower than the $20^{th}$ gray level may be classified as the K group where the black color is dominant.

In addition, when the sum (R+G+B) of the red, green and blue components R, G and B is equal to or greater than the reference gray level, the image classifying portion 241 may compare a Y parameter YP obtained from the red, green and blue components R, G and B with a Y reference value (S223) and may classify the original image signal R, G, B as the Y group where the yellow color (or a white color) is dominant when the Y parameter YP is greater than the Y reference value (S224).

Here, the Y parameter YP is defined from the red and green components R, G of the original image signal R, G, B. For example, the Y parameter YP may be defined as a quotient obtained by dividing the minimum value MIN(R, G) of the red and green components R, G by the maximum value MAX (R, G) of the red and green components R, G. (YP=MIN(R, G)/MAX(R, G)) In addition, the reference value may be determined through an analysis of display quality variation for various test images. For example, the reference value may be determined as about 0.7 by analyzing the display quality variation for a plurality of test images through a method of estimating an image such as a structural similarity index measurement (SSIM). The analysis result through the SSIM may be expressed as a SSIM value within a range of 0 to 1. As the SSIM value approaches 1, the corresponding image is judged less distorted.

Further, when the Y parameter YP is equal to or smaller than the Y reference value, the image classifying portion 241 may convert the original image signal R, G, B regarding red, green and blue colors into the image signal H, S, V regarding hue, saturation and value (S225). Since the red, green and blue components of the original image signal are dependent on each other, the hue of the original image signal R, G, B is not discriminable. Accordingly, the image classifying portion 241 converts the original image signal R, G, B having the red, green and blue components into the image signal H, S, V having the hue, the saturation and the value.

Here, the conversion from the red, green and blue components into the hue, the saturation and the value may be determined according to the following equations.

$$H = \begin{cases} \theta & B \le G \\ 360 - \theta & B > G \end{cases}$$

$$S = 1 - \frac{3\mathrm{MIN}(R, G, B)}{(R + G + B)}$$

$$V = (R + G + B)/3$$

wherein, $$\theta = \cos^{-1}\{(1/2)[(R - G) + (R - B)] / [(R - G)^2 + (R - B)(G - B)]^{1/2}\}$$

Moreover, the image classifying portion 241 classifies the original image signal R, G, B as one of the R, G and B groups by analyzing the hue of the image signal H, S, V (S226). For example, the image classifying portion 241 may determine one of red, green and blue colors having the greatest value as a dominant color by analyzing the hue and may classify the original image signal R, G, B as one of the R, G and B groups. When the original image signal R, G, B has a hue within a range of about −60° (i.e., 300°) to about 60°, the image classifying portion 241 may determine a red color as a dominant color of the original image signal R, G, B and classify the original image signal R, G, B as the R group. Similarly, when the original image signal R, G, B has a hue within a range of about 60° to about 180°, the image classifying portion 241 may determine a green color as a dominant color of the original image signal R, G, B and classify the original image signal R, G, B as the G group. In addition, when the original image signal R, G, B has a hue within a range of about 180° to about 300°, the image classifying portion 241 may determine a blue color as a dominant color of the original image signal R, G, B and classify the original image signal R, G, B as the B group.

As a result, the image classifying portion 241 of the image analyzing portion 240 may classify the original image signal R, G, B into one of the plurality of groups, for example, the R, G, B, Y and K groups and may generate the RGBYK classification signal including the information regarding the classification result. In addition, the image classifying portion 241 of the image analyzing portion 240 may supply the RGBYK classification signal to the variable maximum gain setting portion 249 (of FIG. 6).

Referring again to FIG. 7, the variable maximum gain setting portion 249 of the image analyzing portion 240 sets the variable maximum gain VGNmax according to the classification result in the RGBYK classification signal, i.e., the group which the original image signal R, G, B belongs to (S230) and supplies the set variable maximum gain VGNmax to the color converting portion (of FIG. 5) of the driving portion 230 (of FIG. 5). For example, when the original image signal R, G, B is classified as one of the R, G, B, Y and K groups, the variable maximum gain setting portion 249 may set one of first to fifth variable maximum gain VGNmax corresponding to the group to which the original image signal R, G, B belongs, respectively, as a maximum gain for color conversion.

The color converting portion 250 calculates a first Y data Y1 from the original image signal R, G, B (S240). Here, the first Y data Y1 is calculated by using red and green components R, G of the original image signal R, G, B. For example, a minimum value MIN(R, G) of the red and green components R and G may be determined as the first Y data Y1. (Y1=MIN(R, G))

In addition, the color converting portion 250 calculates a first RGB data R1, G1, B1 by using the original image signal R, G, B and the first Y data Y1 (S250). For example, differences obtained by subtracting the first Y data Y1 from the red and green components R and G may be determined as first R and G data R1 and G1, respectively, and a blue component B of the original image signal R, G, B may be determined as a first B data B1. (R1=R−Y1, G1=G−Y1, B1=B) Here, the first Y data Y1 obtained in the step S240 and the first RGB data R1, G1, B1 obtained in the step S250 may be defined as a first RGBY data R1, G1, B1, Y1.

Further, the color converting portion 250 calculates a first gain GN by using the first RGBY data R1, G1, B1, Y1 (S260). For example, a quotient obtained by dividing a maximum value GRAmax of gray levels GRA of the display device 220 by a maximum value MAX(R1, G1, B1, Y1) of the first RGBY data R1, G1, B1, Y1 may be determined as the first gain GN1. (GN1=GRAmax/MAX(R1, G1, B1, Y1))

Moreover, the color converting portion 250 calculates a second RGBY data R2, G2, B2, Y2 by using the first RGBY data R1, G1, B1, Y1 and the second gain GN2 with the variable maximum gain VGNmax applied as an upper limit (S270). That is, the gain GN2 is a minimum value of the first gain GN1 and the variable maximum gain VGNmax (GN2=MIN(GN1, VGNmax). For example, a product obtained by multiplying the first RGBY data R1, G1, B1, Y1 and the second gain GN2 may be determined as the second RGBY data R2, G2, B2, Y2. (R2=GN2*R1, G2=GN2*G1, B2=GN2*B1, Y2=GN2*Y1)

Here, since the variable maximum gain VGNmax having different values according to the group which the original image signal R, G, B belongs to is used as an upper limit, the gray level saturation in the second RGBY data R2, G2, B2, Y2 is mitigated and the reduction in display quality is prevented. For example, the gray level saturation may be minimized by performing the color conversion with a relatively low variable maximum gain VGNmax for the original image R, G, B corresponding to a color having a relatively high possibility of gray level saturation. In addition, the reduction in brightness may be effectively prevented by performing the color conversion with a relatively high variable maximum gain VGNmax for the original image signal R, G, B corresponding to a color having a relatively low possibility of gray level saturation.

The color converting portion 250 outputs the second RGBY data R2, G2, B2, Y2 as a converted image signal R2, G2, B2, Y2 to the data signal generating portion 260 (S280). The data signal generating portion 260 converts the converted image signal R2, G2, B2, Y2 from a digital type to an analog type and supplies the converted image signal R2, G2, B2, Y2 of an analog type as the data signal to the display panel 220. Since the procedure for calculating the second RGBY data R2, G2, B2, Y2 of the second embodiment is substantially the same as that of the first embodiment, the illustration about the procedure for an exemplary original image signal corresponding to a single pixel P will be omitted.

Here, the procedure for calculating the second RGBY data R2, G2, B2, Y2 in the steps S240 to S270 may be performed for a plurality of original image signals R, G, B corresponding to the plurality of pixels P of the display panel 220. Since the plurality of original image signals R, G, B corresponding to the plurality of pixels P have different values from each other, the obtained gains GN corresponding to the plurality of pixels P may have different values from each other. As a result, the color converting portion 250 generates the plurality of converted image signals R2, G2, B2, Y2 from the plurality of original image signals R, G, B using the plurality of gains GN corresponding to the plurality of pixels P, respectively. Accordingly, brightness of the image is improved and the colors close to a state of nature are displayed.

A plurality of variable maximum gains VGNmax according to the classification result for the original image signal may be determined by the analysis result through the SSIM for a plurality of test images.

Figure 9:
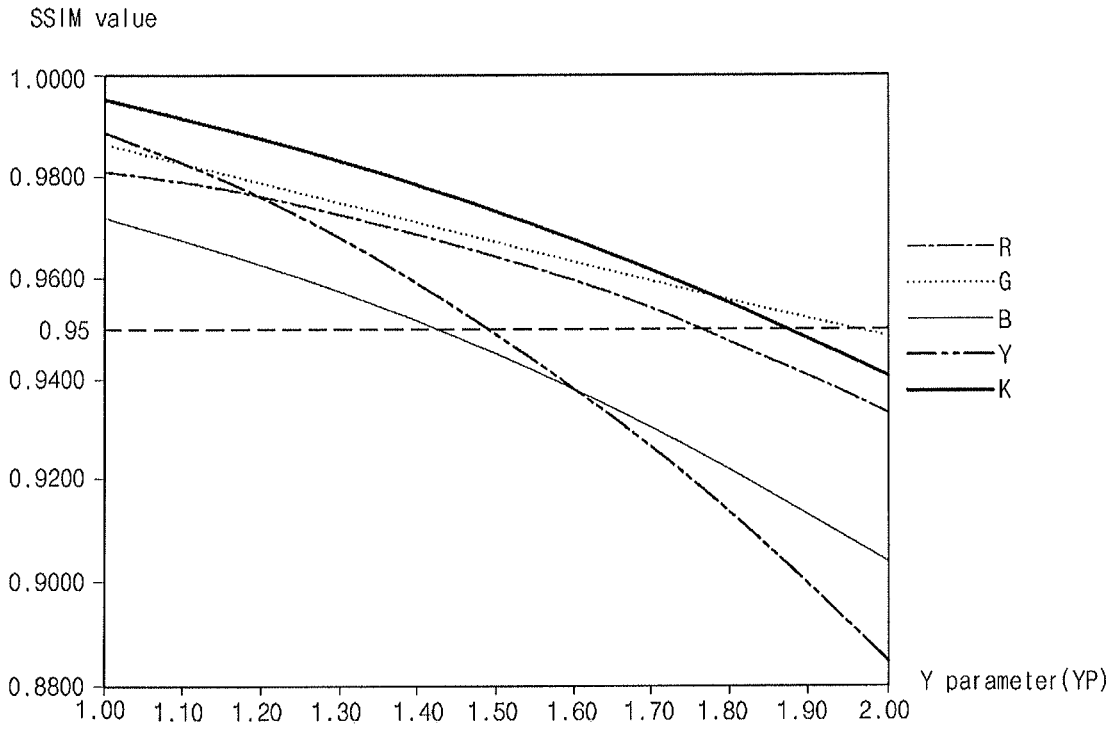
FIG. 9 is a graph showing an image estimation result of for setting image classification references in a driving portion of an image display device according to a second embodiment of the present invention.

TABLE 1 is a table illustrating an image estimation result for setting image classification references in a driving portion of an image display device according to a second embodiment of the present invention, and FIG. 9 is a graph showing an image estimation result of for setting image classification references in a driving portion of an image display device according to a second embodiment of the present invention.

TABLE 1

| | GNmax Image Classification | | | | |
|---|---|---|---|---|---|
| | 1 | 1.25 | 1.5 | 1.75 | 2 |
| R group | 0.9801 | 0.9765 | 0.9636 | 0.9493 | 0.9343 |
| G group | 0.9863 | 0.9775 | 0.9666 | 0.9568 | 0.9488 |
| B group | 0.9705 | 0.9632 | 0.9445 | 0.9243 | 0.9054 |
| Y group | 0.9866 | 0.9754 | 0.9481 | 0.9171 | 0.8866 |
| K group | 0.9945 | 0.9873 | 0.9727 | 0.9566 | 0.9419 |

In TABLE 1 and FIG. 9, a color conversion is performed for a plurality of test images using a plurality of maximum gains GNmax as an upper limit. In addition, a plurality of SSIM values for the plurality of test images before and after the color conversion are calculated, and a plurality of optimum variable maximum gains VGNmax according to the image classification are obtained by analyzing an average of the plurality of SSIM values.

As the maximum gain GNmax increases, the SSIM value decreases and the gray level of the original image signal R, G, B belonging to the R, G, B, Y and K groups is saturated. As a result, display quality is deteriorated. However, the degrees of deterioration in display quality are different among the R, G, B, Y and K groups. Accordingly, when the plurality of maximum gain GNmax having different values are set for the R, G, B, Y and K groups, respectively, brightness is improved with gray level saturation and deterioration in display quality minimized. For example, the image distortion due to color conversion may not be recognized when the SSIM value for an image is equal to or greater than a cognitive permission reference, and the image distortion due to color conversion may be recognized when the SSIM value for an image is smaller than the cognitive permission reference. When the SSIM value of 0.95 is defined as a cognitive permission reference, the plurality of optimum maximum gains GNmax for the R, G, B, Y and K groups may be set within a range of about 1.5 to about 1.75, within a range of about 1.75 to about 2.0, within a range of about 1.25 to about 1.5, within a range of about 1.5 to about 1.75 and within a range of about 1.5 to about 1.75, respectively.

Since the driving portion 230 of the image display device 210 according to the second embodiment of the present invention generates the converted image signal R2, G2, B2, Y2 by applying the variable maximum gain VGNmax according to the classification result for the original image signal R, G, B as an upper limit, the plurality of gains GN used for calculating the converted image signal R2, G2, B2, Y2 have different values equal to or smaller than the variable maximum gain VGNmax according to the original image signal R, G, B.

Figure 10:
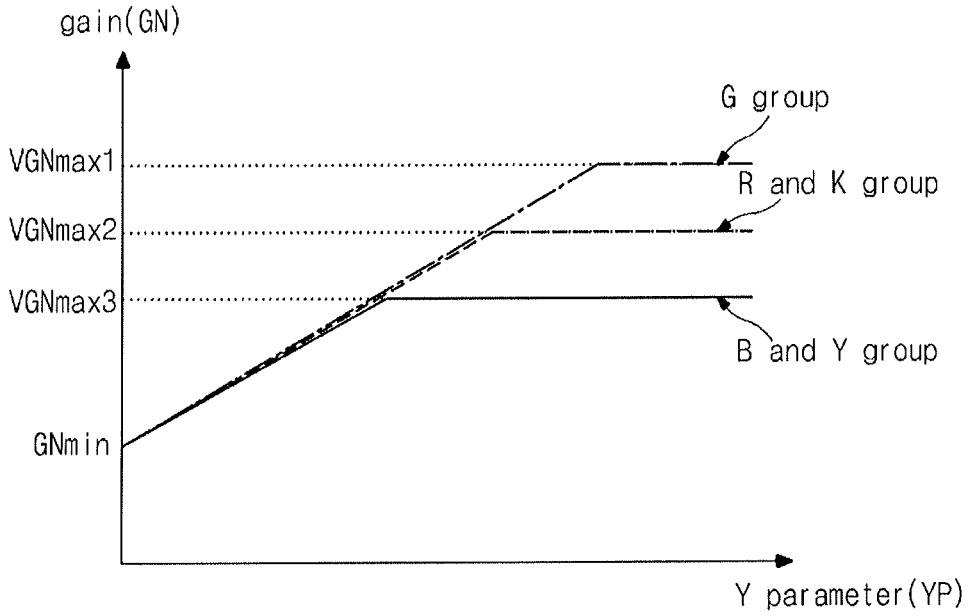
FIG. 10 is a graph showing a gain with respect to a Y parameter used for a method of driving a driving portion of an image display device according to a second embodiment of the present invention.

FIG. 10 is a graph showing a gain with respect to a Y parameter used for a method of driving a driving portion of an image display device according to a second embodiment of the present invention.

In FIG. 10, the plurality of gains GN vary according to a Y parameter YP of the original image signal R, G, B using the variable maximum gain VGNmax as an upper limit. The Y parameter YP is defined from the red and green components R, G of the original image signal R, G, B. For example, the Y parameter YP may be defined as a quotient obtained by dividing the minimum value MIN(R, G) of the red and green components R, G by the maximum value MAX(R, G) of the red and green components R, G. (YP=MIN(R, G)/MAX(R, G))

When the original image signal R, G, B may be classified as one of the R, G, B, Y and K groups, the maximum gain GNmax for the G group may be set as a first variable maximum gain VGNmax1 within a range of about 1.75 to about 2.0, for example, about 2.0. Further, the maximum gain GNmax for the R and K groups may be set as a second variable maximum gain VGNmax2 within a range of about 1.5 to about 1.75, for example, about 1.75, the maximum gain GNmax for the B group may be set as a third variable maximum gain VGNmax3 of about 1.5 within a range of about 1.25 to about 1.5, for example, about 1.5, and the maximum gain GNmax for the Y group may be set as the third variable maximum gain VGNmax3 within a range of about 1.5 to about 1.75, for example, about 1.5.

The graph of FIG. 10 shows variation range of the gain GN applied to the original image signal R, G, B. As a result, the image signal R, G, B belonging to the G group may be converted using the plurality of gains GN within a range of a minimum gain GNmin to the first variable maximum gain VGNmax1, for example, about 2.0. In addition, the image signal R, G, B belonging to the R and K groups may be converted using the plurality of gains GN within a range of the minimum gain GNmin to the second maximum gain VGNmax2, for example, about 1.75, and the image signal R, G, B belonging to the B and Y groups may be converted using the plurality of gains GN within a range of the minimum gain GNmin to the third maximum gain VGNmax3, for example, about 1.5.

Accordingly, in the image display device 210 according to the second embodiment of the present invention, since the converted image signal R2, G2, B2, Y2 is generated from the original image signal R, G, B using the plurality of gains GN having various values corresponding to the plurality of pixels P, brightness of the image is improved and the colors close to a state of nature are displayed.

In addition, since the converted image signal R2, G2, B2, Y2 is generated from the original image signal R, G, B using the plurality of gains GN with the variable maximum gain VGNmax as an upper limit, gray level saturation is minimized and display quality is further improved.

Although the yellow color as an auxiliary primary color is added to the red, green and blue colors in the first and second embodiments, a cyan color as an auxiliary primary color may be added to the red, green and blue colors in another embodiment.

Figure 11:
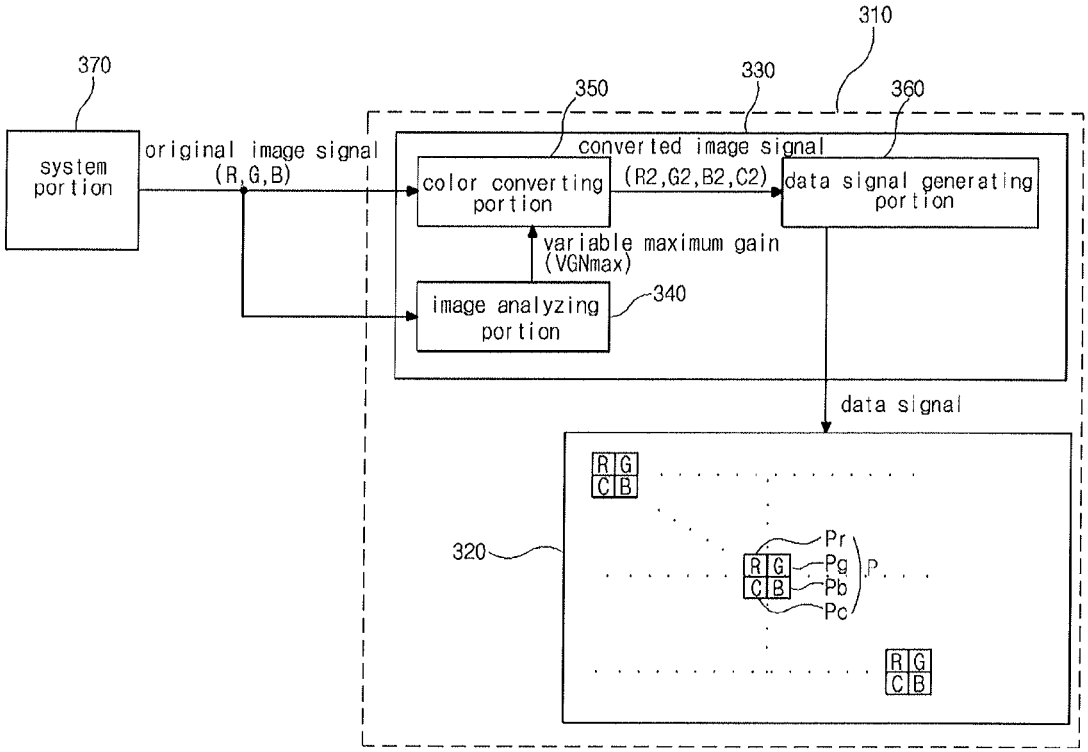
FIG. 11 is a view showing an image display device according to a third embodiment of the present invention.

FIG. 11 is a view showing an image display device according to a third embodiment of the present invention.

In FIG. 11, an image display device 310 according to a third embodiment of the present invention includes a display panel 320 that displays an image using a plurality of pixels P and a driving portion 330 that generates a data signal from an original image signal R, G, B and supplies the data signal to the display panel 320. The display panel 320 that uses a cyan color as an auxiliary primary color includes the plurality of pixels P each having red, green, blue and cyan sub-pixels Pr, Pg, Pb and Pc. The display panel 320 displays the image of a frame by applying the different data signals to the plurality of pixels P.

The driving portion 330 includes an image analyzing portion 340, a color converting portion 350 and a data signal generating portion 360. The driving portion 330 receives the original image signal R, G, B and a plurality of control signals from an external system portion 370 such as a graphic card or a television system. In addition, the driving portion 330 generates the data signal using the original image signal R, G, B and the plurality of control signals and supplies the data signal to the display panel 320.

For example, the system portion 370 may supply the original image signal R, G, B of a digital type regarding red, green and blue colors and the plurality of control signals including a data enable signal (DE), a vertical synchronization signal (VSY), a horizontal synchronization signal (HSY) and a clock signal (CLK) to the driving portion 330. The image analyzing portion 340 may generate a variable maximum gain VGNmax corresponding to the original image signal R, G, B by analyzing the original image signal R, G, B of a digital type regarding red, green and blue colors and may supply the variable maximum gain VGNmax to the color converting portion 350. As an example, the image analyzing portion 340 may generate, for each pixel, a variable maximum gain VGNmax corresponding to the original image signal R, G, B as the upper limit of the gain for the pixel, by analyzing the original image signal R, G, B of a digital type regarding red, green and blue colors and may supply the variable maximum gain VGNmax to the color converting portion 350.

The color converting portion 350 may generate a converted image signal R2, G2, B2, C2 of a digital type regarding red, green, blue and cyan colors from the original image signal R, G, B of a digital type regarding red, green and blue colors by using the variable maximum gain VGNmax and may supply the converted image signal R2, G2, B2, C2 to the data signal generating portion 360. In addition, the data signal generating portion 360 may generate the data signal of an analog type regarding red, green, blue and cyan colors using the converted image signal R2, G2, B2, C2 of a digital type and the plurality of control signals and may supply the data signal to the display panel 320.

The data signal of an analog type regarding red, green, blue and cyan colors are applied to red, green, blue and cyan sub-pixels Pr, Pg, Pb and Pc, respectively, of the display panel 320. As a result, the corresponding pixel P may display a colored image close to a state of nature.

The image analyzing portion 340 that generates the variable maximum gain VGNmax by analyzing the original image signal will be illustrated referring to a drawing hereinafter.

Figure 12:
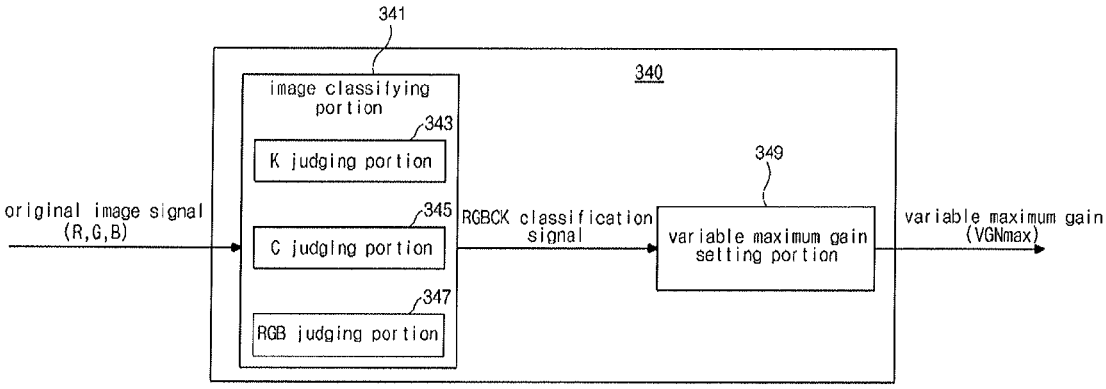
FIG. 12 is a view showing an image analyzing portion of an image display device according to a third embodiment of the present invention.

FIG. 12 is a view showing an image analyzing portion of an image display device according to a third embodiment of the present invention.

In FIG. 12, the image analyzing portion 340 includes an image classifying portion 341 and a variable maximum gain setting portion 349. The image classifying portion 341 classifies the original image signal R, G, B into a plurality of groups by analysis and generates an RGBCK classification signal including information of the group where the original image signal R, G, B belongs. The variable maximum gain setting portion 349 generates the variable maximum gain VGNmax according to the RGBCK classification signal. The variable maximum gain VGNmax corresponds to the group where the original image signal R, G, B belongs.

For example, when the plurality of groups include R, G, B, C and K groups where red, green, blue, cyan and black colors are dominant, respectively, the image classifying portion 341 may includes a K judging portion 343, a C judging portion 345 and an RGB judging portion 347. The K judging portion 343 may judge whether the original image signal R, G, B belongs to the K group where black color is dominant and the C judging portion 345 may judge the original image signal R, G, B belongs to the C group where cyan color is dominant. In addition, the RGB judging portion 347 may judge which one of the R, G and B groups where red, green and blue colors are dominant, respectively, the original image signal R, G, B belongs to.

For the purpose of clarifying discrimination among red, green and blue colors, the RGB judging portion 347 may include an RGB to HSV converting portion (not shown) that converts the original image signal R, G, B regarding red, green and blue colors into an image signal H, S, V regarding hue, saturation and value, and may judge which one of the R, G and B groups the original image signal R, G, B belongs to by analyzing the hue component of the image signal H, S, V.

The variable maximum gain setting portion 349 generates the variable maximum gain VGNmax according to the RGBCK classification signal from the image classifying portion 341. The variable maximum gain setting portion 349 may store information regarding a plurality of variable maximum gain VGNmax corresponding to the plurality of groups according to classification of the image classifying portion 341 as a form of a look-up table (LUT). For example, when the image classifying portion 341 classifies an image of a frame into R, G, B, C and K groups, the variable maximum gain setting portion 349 may store first to fifth variable maximum gain VGNmax corresponding to the R, G, B, C and K groups, respectively.

Operation of the driving portion 330 will be illustrated referring to drawings hereinafter.

Figure 13:
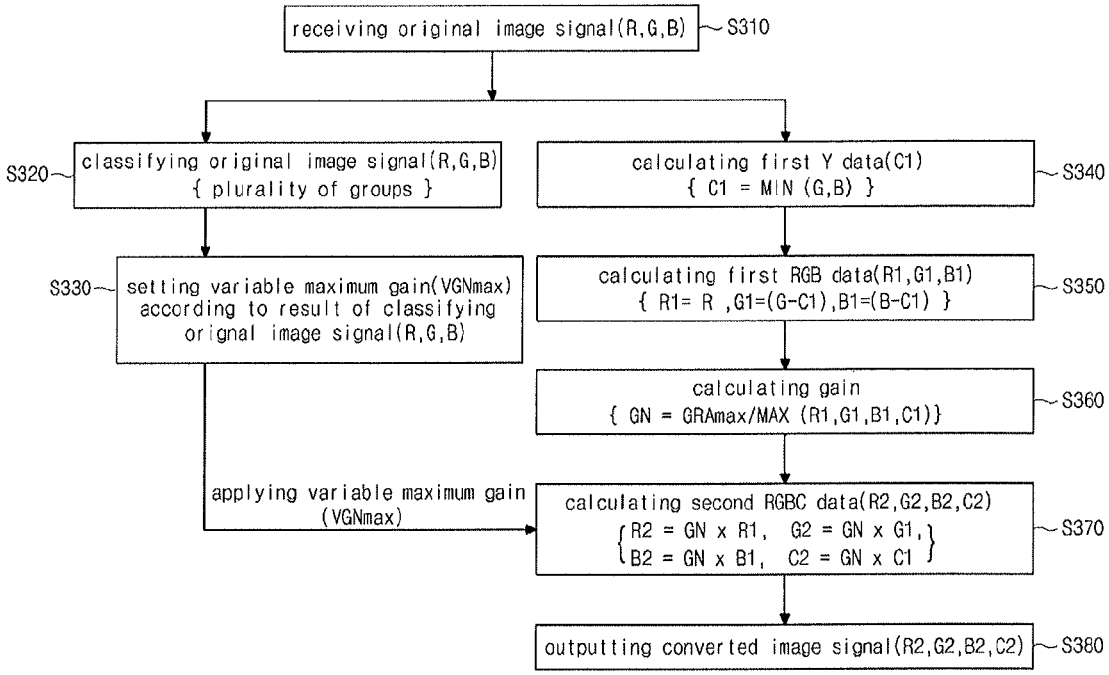
FIG. 13 is a flow chart showing a method of driving a driving portion of an image display device according to a third embodiment of the present invention.
Figure 14:
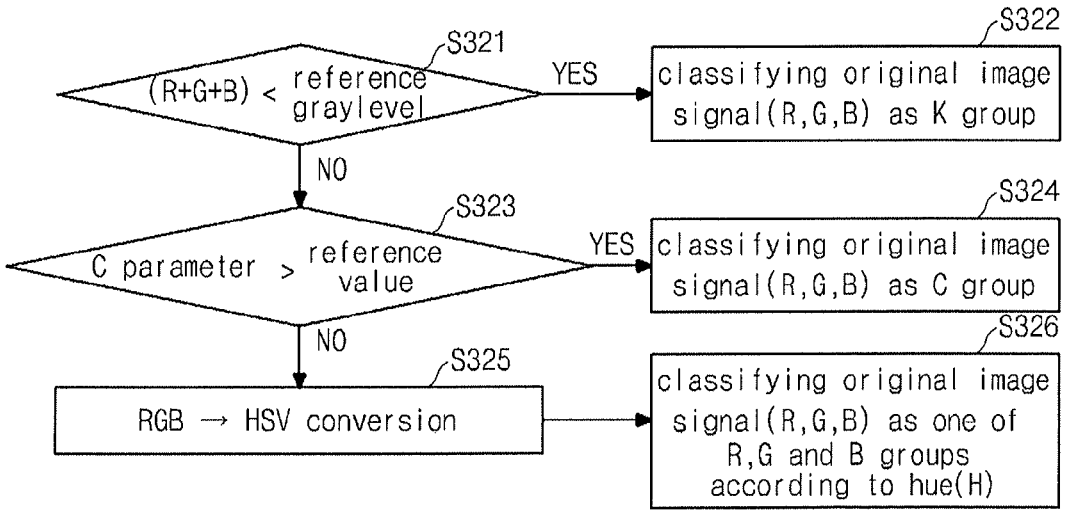
FIG. 14 is a flow chart showing a method of classifying an image in an image analyzing portion of a driving portion of an image display device according to a third embodiment of the present invention.

FIG. 13 is a flow chart showing a method of driving a driving portion of an image display device according to a third embodiment of the present invention, and FIG. 14 is a flow chart showing a method of classifying an image in an image analyzing portion of a driving portion of an image display device according to a third embodiment of the present invention.

In FIG. 13, when the driving portion 330 (of FIG. 11) receives the original image signal R, G, B regarding red, green and blue colors from the system portion 370 (of FIG. 11) (S310), the image analyzing portion 340 (of FIG. 11) analyzes the original image signal R, G, B and classifies the original image signal R, G, B into the plurality of groups (S320).

An image classification reference and an image classification method may be variously selected in the image analyzing portion 340. For example, as shown in FIG. 14 where the original image signal R, G, B is classified into the R, G, B, C and K groups, the image classifying portion 341 (of FIG. 12) of the image analyzing portion 340 may compare a sum (R+G+B) of red, green and blue components R, G and B of the original image signal R, G, B with a reference gray level (S321) and may classify the original image signal R, G, B as the K group where the black color is dominant when the sum (R+G+B) of the red, green and blue components R, G and B is smaller than the reference gray level.

Here, the reference gray level may be determined through various methods. For example, the original image signal R, G, B having a gray level lower than the $20^{th}$ gray level may be judged to have such a low brightness that a user can not discriminate therebetween. As a result, the $20^{th}$ gray level may be determined as the reference gray level and the original image signal R, G, B having a gray level lower than the $20^{th}$ gray level may be classified as the K group where the black color is dominant.

In addition, when the sum (R+G+B) of the red, green and blue components R, G and B is equal to or greater than the reference gray level, the image classifying portion 341 may compare a C parameter CP, as another example of the auxiliary primary color parameter, obtained from the red, green and blue components R, G and B with a C reference value (S323) and may classify the original image signal R, G, B as the C group where the cyan color (or a white color) is dominant when the C parameter CP is greater than the C reference value (S324).

Here, the C parameter CP is defined from the green and blue components G, B of the original image signal R, G, B which are two components of the original image signal R, G, B forming the yellow color. For example, the C parameter CP may be defined as a quotient obtained by dividing the minimum value MIN(G, B) of the green and blue components G, B by the maximum value MAX(G, B) of the green and blue components G, B. (CP=MIN(G, B)/MAX(G, B)) In addition, the reference value may be determined through an analysis of display quality variation for various test images. For example, the C reference value may be determined as about 0.7 by analyzing the display quality variation for a plurality of test images through a method of estimating an image such as a structural similarity index measurement (SSIM). The analysis result through the SSIM may be expressed as a SSIM value within a range of 0 to 1. As the SSIM value approaches 1, the corresponding image is judged less distorted.

Further, when the C parameter CP is equal to or smaller than the C reference value, the image classifying portion 341 may convert the original image signal R, G, B regarding red, green and blue colors into the image signal H, S, V regarding hue, saturation and value (S325). Since the red, green and blue components of the original image signal are dependent on each other, the hue of the original image signal R, G, B is not discriminable. Accordingly, the image classifying portion 341 converts the original image signal R, G, B having the red, green and blue components into the image signal H, S, V having the hue, the saturation and the value.

Here, the conversion from the red, green and blue components into the hue, the saturation and the value may be determined according to the following equations.

$$H = \begin{cases} \theta & B \le G \\ 360 - \theta & B > G \end{cases}$$

$$S = 1 - \frac{3\mathrm{MIN}(R, G, B)}{(R + G + B)}$$

$$V = (R + G + B)/3$$

wherein, $$\theta = \cos^{-1}\{(1/2)[(R - G) + (R - B)] / [(R - G)^2 + (R - B)(G - B)]^{1/2}\}$$

Moreover, the image classifying portion 341 classifies the original image signal R, G, B as one of the R, G and B groups by analyzing the hue of the image signal H, S, V (S326). For example, the image classifying portion 341 may determine one of red, green and blue colors having the greatest value as a dominant color by analyzing the hue and may classify the original image signal R, G, B as one of the R, G and B groups. When the original image signal R, G, B has a hue within a range of about −60° (i.e., 300°) to about 60°, the image classifying portion 241 may determine a red color as a dominant color of the original image signal R, G, B and classify the original image signal R, G, B as the R group. Similarly, when the original image signal R, G, B has a hue within a range of about 60° to about 180°, the image classifying portion 241 may determine a green color as a dominant color of the original image signal R, G, B and classify the original image signal R, G, B as the G group. In addition, when the original image signal R, G, B has a hue within a range of about 180° to about 300°, the image classifying portion 241 may determine a blue color as a dominant color of the original image signal R, G, B and classify the original image signal R, G, B as the B group.

As a result, the image classifying portion 341 of the image analyzing portion 340 may classify the original image signal R, G, B into one of the plurality of groups, for example, the R, G, B, C and K groups and may generate the RGBCK classification signal including the information regarding the classification result. In addition, the image classifying portion 341 of the image analyzing portion 340 may supply the RGBCK classification signal to the variable maximum gain setting portion 349 (of FIG. 12).

Referring again to FIG. 13, the variable maximum gain setting portion 349 of the image analyzing portion 340 sets the variable maximum gain VGNmax according to the classification result in the RGBCK classification signal, i.e., the group which the original image signal R, G, B belongs to (S330) and supplies the set variable maximum gain VGNmax to the color converting portion (of FIG. 11) of the driving portion 330 (of FIG. 11). For example, when the original image signal R, G, B is classified as one of the R, G, B, C and K groups, the variable maximum gain setting portion 349 may set one of first to fifth variable maximum gain VGNmax corresponding to the group to which the original image signal R, G, B belongs, respectively, as a maximum gain for color conversion.

The color converting portion 350 calculates a first C data C1 from the original image signal R, G, B (S340). Here, the first C data C1 is calculated by using green and blue components G, B of the original image signal R, G, B. For example, a minimum value MIN(G, B) of the green and blue components G and B may be determined as the first C data C1. (C1=MIN(G, B))

In addition, the color converting portion 350 calculates a first RGB data R1, G1, B1 by using the original image signal R, G, B and the first C data C1 (S350). For example, a red component R of the original image signal R, G, B may be determined as a first R data R1 and differences obtained by subtracting the first C data C1 from the green and blue components G and B may be determined as first G and B data G1 and B1, respectively. (R1=R, G1=G−C1, B1=B−C1) Here, the first C data C1 obtained in the step S340 and the first RGB data R1, G1, B1 obtained in the step S350 may be defined as a first RGBC data R1, G1, B1, C1.

Further, the color converting portion 350 calculates a first gain GN1 by using the first RGBC data R1, G1, B1, C1 (S360). For example, a quotient obtained by dividing a maximum value GRAmax of gray levels GRA of the display device 320 by a maximum value MAX(R1, G1, B1, C1) of the first RGBC data R1, G1, B1, C1 may be determined as the first gain GN1. (GN1=GRAmax/MAX(R1, G1, B1, C1))

Moreover, the color converting portion 350 calculates a second RGBC data R2, G2, B2, C2 by using the first RGBC data R1, G1, B1, C1 and the second gain GN 2 with the variable maximum gain VGNmax applied as an upper limit (S370). That is, the gain GN2 is a minimum value of the first gain GN1 and the variable maximum gain VGNmax (GN2=MIN(GN1, VGNmax). For example, a product obtained by multiplying the first RGBC data R1, G1, B1, C1 and the second gain GN2 may be determined as the second RGBC data R2, G2, B2, C2. (R2=GN2*R1, G2=GN2*G1, B2=GN2*B1, C2=GN2*C1)

Here, since the variable maximum gain VGNmax having different values according to the group which the original image signal R, G, B belongs to is used as an upper limit, the gray level saturation in the second RGBC data R2, G2, B2, C2 is mitigated and the reduction in display quality is prevented. For example, the gray level saturation may be minimized by performing the color conversion with a relatively low variable maximum gain VGNmax for the original image R, G, B corresponding to a color having a relatively high possibility of gray level saturation. In addition, the reduction in brightness may be effectively prevented by performing the color conversion with a relatively high variable maximum gain VGNmax for the original image signal R, G, B corresponding to a color having a relatively low possibility of gray level saturation.

The color converting portion 350 outputs the second RGBC data R2, G2, B2, C2 as a converted image signal R2, G2, B2, C2 to the data signal generating portion 360 (S380). The data signal generating portion 360 converts the converted image signal R2, G2, B2, C2 from a digital type to an analog type and supplies the converted image signal R2, G2, B2, C2 of an analog type as the data signal to the display panel 320. Since the procedure for calculating the second RGBC data R2, G2, B2, C2 of the third embodiment is substantially the same as those of the first and second embodiments, the illustration about the procedure for an exemplary original image signal corresponding to a single pixel P will be omitted.

Here, the procedure for calculating the second RGBC data R2, G2, B2, C2 in the steps S340 to S370 may be performed for a plurality of original image signals R, G, B corresponding to the plurality of pixels P of the display panel 320. Since the plurality of original image signals R, G, B corresponding to the plurality of pixels P have different values from each other, the obtained gains GN corresponding to the plurality of pixels P may have different values from each other. As a result, the color converting portion 350 generates the plurality of converted image signals R2, G2, B2, C2 from the plurality of original image signals R, G, B using the plurality of gains GN corresponding to the plurality of pixels P, respectively. Accordingly, brightness of the image is improved and the colors close to a state of nature are displayed.

A plurality of variable maximum gains VGNmax according to the classification result for the original image signal may be determined by the analysis result through the SSIM for a plurality of test images. After a color conversion is performed for a plurality of test images using a plurality of maximum gains GNmax as an upper limit, a plurality of SSIM values for the plurality of test images before and after the color conversion are calculated. In addition, a plurality of optimum variable maximum gains VGNmax according to the image classification are obtained by analyzing an average of the plurality of SSIM values.

As the maximum gain GNmax increases, the SSIM value decreases and the gray level of the original image signal R, G, B belonging to the R, G, B, C and K groups is saturated. As a result, display quality is deteriorated. However, the degrees of deterioration in display quality are different among the R, G, B, C and K groups. Accordingly, when the plurality of maximum gain GNmax having different values are set for the R, G, B, C and K groups, respectively, brightness is improved with gray level saturation and deterioration in display quality minimized. For example, the image distortion due to color conversion may not be recognized when the SSIM value for an image is equal to or greater than a cognitive permission reference, and the image distortion due to color conversion may be recognized when the SSIM value for an image is smaller than the cognitive permission reference. When the SSIM value of 0.95 is defined as a cognitive permission reference, the plurality of optimum maximum gains GNmax for the R, G, B, C and K groups may be set within a range of about 1.5 to about 1.75 (for example, about 1.75), within a range of about 1.5 to about 2.0 (for example, about 2.0), within a range of about 1.0 to about 1.5 (for example, about 1.5), within a range of about 1.25 to about 1.75 (for example, about 1.75) and within a range of about 1.25 to about 1.75 (for example, about 1.75), respectively.

Accordingly, in the image display device 310 according to the third embodiment of the present invention, since the converted image signal R2, G2, B2, C2 is generated from the original image signal R, G, B using the plurality of gains GN having various values corresponding to the plurality of pixels P, brightness of the image is improved and the colors close to a state of nature are displayed.

In addition, since the converted image signal R2, G2, B2, C2 is generated from the original image signal R, G, B using the plurality of gains GN with the variable maximum gain VGNmax as an upper limit, gray level saturation is minimized and display quality is further improved.

Consequently, in an image display device according to the present invention, since red, green, blue and auxiliary primary color data signals are generated from red, green and blue image signals by using a plurality of gains corresponding to a plurality of pixels, brightness is improved and colors close to a state of nature are displayed. In addition, since the red, green, blue and auxiliary primary color data signals are generated from the red, green and blue image signals by using a variable maximum gain having different values according to a kind of an image and the plurality of gains corresponding to the plurality of pixels, brightness is improved, and display quality and contrast ratio are improved with gray level saturation region minimized.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. An image display device, comprising:

a display panel including a plurality of pixels and displaying an image;

circuitry configured to:

generate, for each pixel, a converted image signal regarding red, green and blue colors and an auxiliary primary color from an original image signal regarding red, green and blue colors using a corresponding one of a plurality of gains corresponding to the pixels;

determine a maximum gain as an upper limit for each of the plurality of gains, wherein the gain for each pixel is a minimum value of both a first gain determined from the original image signal of the pixel and the maximum gain, and wherein the first gain for each pixel is obtained from a maximum value of gray levels of the display panel and a maximum value of red color, green color, blue color and auxiliary primary color components of the converted image signal for the pixel; and generate a data signal from the converted image signal and supplying the data signal to the display panel, wherein the auxiliary primary color is a combination of two of the red, green and blue colors.

2. The device according to claim 1, wherein the plurality of gains have different values according to the original image signal.

3. The device according to claim 1, wherein the maximum gain is determined as the upper limit for each of the plurality of gains is set as a fixed maximum gain.

4. The device according to claim 1, wherein the maximum gain is determined as the upper limit for each of the plurality of gains is set as a variable maximum gain, which varies according to the original image signal.

5. The device according to claim 4, wherein the circuitry is further configured to:

classify the original image signal into a plurality of groups and generate a classification signal, wherein the classification signal includes an information indicating the group to which the original image signal belongs, out of the plurality of groups; and calculate the variable maximum gain according to the classification signal.

6. The device according to claim 5, wherein the original image signal is classified as a first group in response to a black color being dominant when a sum of the red, green and blue components of the original image signal is smaller than a reference gray level, in response to the sum of the red, green and blue components of the original image signal not being smaller than the reference gray level, the original image signal is classified as a second group where the auxiliary primary color is dominant when an auxiliary primary color parameter is greater than a reference value, the auxiliary primary color parameter defined as a quotient obtained by dividing a minimum value of two components of the original image signal forming the auxiliary primary color by a maximum value of the two components of the original image signal, and in response to the sum of the red, green and blue components of the original image signal not being smaller than the reference gray level, the image classifying portion classifies the original image signal as one of a third, fourth and fifth groups, when the auxiliary primary color parameter is equal to or smaller than the reference value, wherein red color is dominant in the third group, the green color is dominant in the fourth group and the blue color is dominant in the fifth group.

7. The device according to claim 6, wherein the auxiliary primary color is a yellow color, the auxiliary primary color parameter is defined as a quotient obtained by dividing a minimum value of the red and green components of the original image signal by a maximum value of the red and green components of the original image signal.

8. The device according to claim 7, wherein the reference gray level is 20th gray level of the display panel, the reference value is about 0.7, the variable maximum gain corresponding to the fourth group is within a range of about 1.75 to about 2.0, the variable maximum gain corresponding to the first, second and third groups is within a range of about 1.5 to about 1.75, and the variable maximum gain corresponding to the fifth group is within a range of about 1.25 to about 1.5.

9. The device according to claim 6, wherein the auxiliary primary color is a cyan color, the auxiliary primary color parameter is defined as a quotient obtained by dividing a minimum value of the green and blue components of the original image signal by a maximum value of the green and blue components of the original image signal.

10. The device according to claim 9, wherein the reference gray level is 20th gray level of the display panel, the reference value is about 0.7, the variable maximum gain corresponding to the fourth group is within a range of about 1.5 to about 2.0, the variable maximum gain corresponding to the third group is within a range of about 1.5 to about 1.75, the variable maximum gain corresponding to the first and second groups is within a range of about 1.25 to about 1.75, and the variable maximum gain corresponding to the fifth group is within a range of about 1.0 to about 1.5.

11. The device according to claim 1, wherein the auxiliary primary color is a yellow color, the gain for each pixel is determined by the following equation:

$$GN = \mathrm{MIN}\left(\frac{GRA\max}{\mathrm{MAX}(R1, G1, B1, Y1)}, GN\max\right)$$

wherein, GN is the gain for the pixel, GRAmax is the maximum value of gray levels of the display panel, Y1=MIN(R,G), R1=R−Y1; G1=G−Y1; B1=B, and GNmax is the maximum gain, R is a red component of the original image signal for the pixel, G is a green component of the original image signal for the pixel, and B is a blue component of the original image signal for the pixel.

12. The device according to claim 1, wherein the auxiliary primary color is a cyan color, wherein the gain for each pixel is determined by the following equation:

$$GN = \mathrm{MIN}\left(\frac{GRA\max}{\mathrm{MAX}(R1, G1, B1, C1)}, GN\max\right)$$

wherein, GN is the gain for the pixel, GRAmax is the maximum value of gray levels of the display panel, C1=MIN(G,B), R1=R; G1=G−C1; B1=B−C1, and GNmax is the maximum gain, R is a red component of the original image signal for the pixel, G is a green component of the original image signal for the pixel, and B is a blue component of the original image signal for the pixel.

13. A method of driving an image display device, comprising:

generating, for each pixel of a display panel of the image display device, a converted image signal regarding red, green and blue colors and an auxiliary primary color from an original image signal regarding red, green and blue colors using one of a plurality of gains corresponding to the pixel;

determining as an upper limit for each of the plurality of gains, wherein the gain for each pixel is a minimum value of both a first gain determined from the original image signal of the pixel and the maximum gain, and wherein the first gain for each pixel is obtained from a maximum value of gray levels of the display panel and a maximum value of red color, green color, blue color and auxiliary primary color components of the converted image signal for the pixel;

generating a data signal from the converted image signal; and displaying an image using the data signal in a display panel of the image display device, wherein the auxiliary primary color is a combination of two of the red, green and blue colors.

14. The method according to claim 13, wherein the plurality of gains have different values according to the original image signal.

15. The method according to claim 13, wherein the maximum gain is determined as the upper limit for each of the plurality of gains is set as a fixed maximum gain.

16. The method according to claim 13, wherein the maximum gain is determined as the upper limit for each of the plurality of gains is set as a variable maximum gain, which varies according to the original image signal.

17. The method according to claim 16, wherein the variable maximum gain is generated by:

classifying the original image signal into a plurality of groups and generating a classification signal, wherein the classification signal includes an information indicating the group to which the original image signal belongs, out of the plurality of groups; and generating the variable maximum gain according to the classification signal.

18. The method according to claim 17, wherein the original image signal is classified as a first group where a black color is dominant when a sum of the red, green and blue components of the original image signal is smaller than a reference gray level, wherein, when the sum of the red, green and blue components of the original image signal is not smaller than the reference gray level, the original image signal is classified as a second group where the auxiliary primary color is dominant when a auxiliary primary color parameter is greater than a reference value, the auxiliary primary parameter defined as a quotient obtained by dividing a minimum value of the two components of the original image signal forming the auxiliary primary color by a maximum value of the two components of the original image signal, and wherein when the sum of red, green and blue components of the original image signal is not smaller than the reference gray level, the original image signal is classified as one of a third, fourth and fifth groups, when the auxiliary primary color parameter is equal to or smaller than the reference value, wherein the red color is dominant in the third group, the green color is dominant in the fourth group and blue color is dominant in the fifth group.

19. The method according to claim 18, wherein the auxiliary primary color is a yellow color, the auxiliary primary color parameter is defined as a quotient obtained by dividing a minimum value of the red and green components of the original image signal by a maximum value of the red and green components of the original image signal.

20. The method according to claim 13, wherein the auxiliary primary color is a yellow color, the gain for each pixel of the display panel is determined by the following equation:

$$GN = \mathrm{MIN}\left(\frac{GRA\max}{\mathrm{MAX}(R1, G1, B1, Y1)}, GN\max\right)$$

wherein, GN is the gain for the pixel, GRAmax is the maximum value of gray levels of the display panel, Y1=MIN(R,G), R1=R−Y1; G1=G−Y1; B1=B, and GNmax is the maximum gain, R is a red component of the original image signal for the pixel, G is a green component of the original image signal for the pixel, and B is a blue component of the original image signal for the pixel.

21. The method according to claim 13, wherein the auxiliary primary color is a cyan color, wherein the gain for each pixel of the display panel is determined by the following equation:

$$GN = \mathrm{MIN}\left(\frac{GRA\max}{\mathrm{MAX}(R1, G1, B1, C1)}, GN\max\right)$$

wherein, GN is the gain for the pixel, GRAmax is the maximum value of gray levels of the display panel, C1=MIN(G,B), R1=R; G1=G−C1; B1=B−C1, and GNmax is the maximum gain, R is a red component of the original image signal for the pixel, G is a green component of the original image signal for the pixel, and B is a blue component of the original image signal for the pixel.

22. The method according to claim 18, wherein the auxiliary primary color is a cyan color, the auxiliary primary color parameter is defined as a quotient obtained by dividing a minimum value of the green and blue components of the original image signal by a maximum value of the green and blue components of the original image signal.

* * * * *